US006279778B1

(12) United States Patent
Ho et al.

(10) Patent No.: US 6,279,778 B1
(45) Date of Patent: Aug. 28, 2001

(54) LIQUID DISPENSER WITH AN ORNAMENTAL DEVICE

(75) Inventors: Stanley Ho, 18, Nottingham Way, Warren, NJ (US) 07059; Hsiao-Liang Ho, Taipei (TW)

(73) Assignee: Stanley Ho, Warren, NJ (US)

( * ) Notice: Subject to any disclaimer, the term of this patent is extended or adjusted under 35 U.S.C. 154(b) by 0 days.

(21) Appl. No.: 09/588,854

(22) Filed: Jun. 6, 2000

(51) Int. Cl.[7] ..... B67D 5/60
(52) U.S. Cl. ..... 222/78; 222/321.7; 446/267
(58) Field of Search ..... 222/78, 321.7, 222/321.9; 446/267

(56) References Cited

U.S. PATENT DOCUMENTS 6,193,106 * 2/2001 Ho et al. ..... 222/78
6,223,939 * 5/2001 Bitton ..... 222/79

* cited by examiner

*Primary Examiner*—Philippe Derakshani

(57) ABSTRACT

A liquid dispenser with an ornamental device having a spiral extension securely extending from a bottom of the container; a hollow cylinder; a clamping ring for securely engaging the hollow cylinder with the bottom of the container; a resilient member compressibly mounted around the spiral extension and a free end of which abuts against the bottom of the container; and a rotating device received in the hollow cylinder. A force applied to the liquid dispenser will drive the rotating device to rotate. Therefore, when a roulette or a compass is mounted onto the rotating disk, the rotation of the rotating disk will increase the overall attraction.

5 Claims, 6 Drawing Sheets

LIQUID DISPENSER WITH AN ORNAMENTAL DEVICE

BACKGROUND OF THE INVENTION

1. Field of the Invention

The present invention relates to a liquid dispenser, and more particularly to a liquid dispenser with an ornamental device having a spiral extension extending into a rotating disk and a base provided to support the rotating disk. With such an arrangement, when the user presses the liquid dispenser to extend the spiral extension into the rotating disk, the rotating disk will thus rotate relative to the base. Therefore, if a roulette or a compass is mounted onto the rotating disk, every time the user uses the dispenser, the roulette or the compass will increase the attraction to the liquid dispenser.

2. Prior Art Description

A conventional liquid dispenser normally has a cylindrical container, a mouth and a dispensing device. The cylindrical container is equipped with body lotion, baby oil or the like. The mouth is to direct the liquid contained in the container for use. The dispensing device is provided to drain the liquid to flow out of the container through the mouth. The function of the liquid dispenser is limited only to contain the liquid therein, which is quite a waste.

The present invention provides an improved liquid dispenser to overcome the above mentioned shortcomings.

SUMMARY OF THE INVENTION

The primary objective of the invention is to provide an improved liquid dispenser with an ornamental device having a spiral extension, a rotating disk defined therein a slot for receiving the spiral extension and a base provided to support the rotating disk thereon. The press to the liquid dispenser will cause the spiral extension to extend into the slot of the rotating disk, which will drive the rotating disk to rotate relative to the base. Therefore, if a roulette or a compass is mounted onto the rotating disk, every time the user uses the liquid dispenser, the rotation of the rotating disk will increase the attraction to the liquid dispenser.

Other objects, advantages and novel features of the invention will become more apparent from the following detailed description when taken in conjunction with the accompanying drawings.

DETAILED DESCRIPTION TO THE PREFERRED EMBODIMENT

Figure 1:
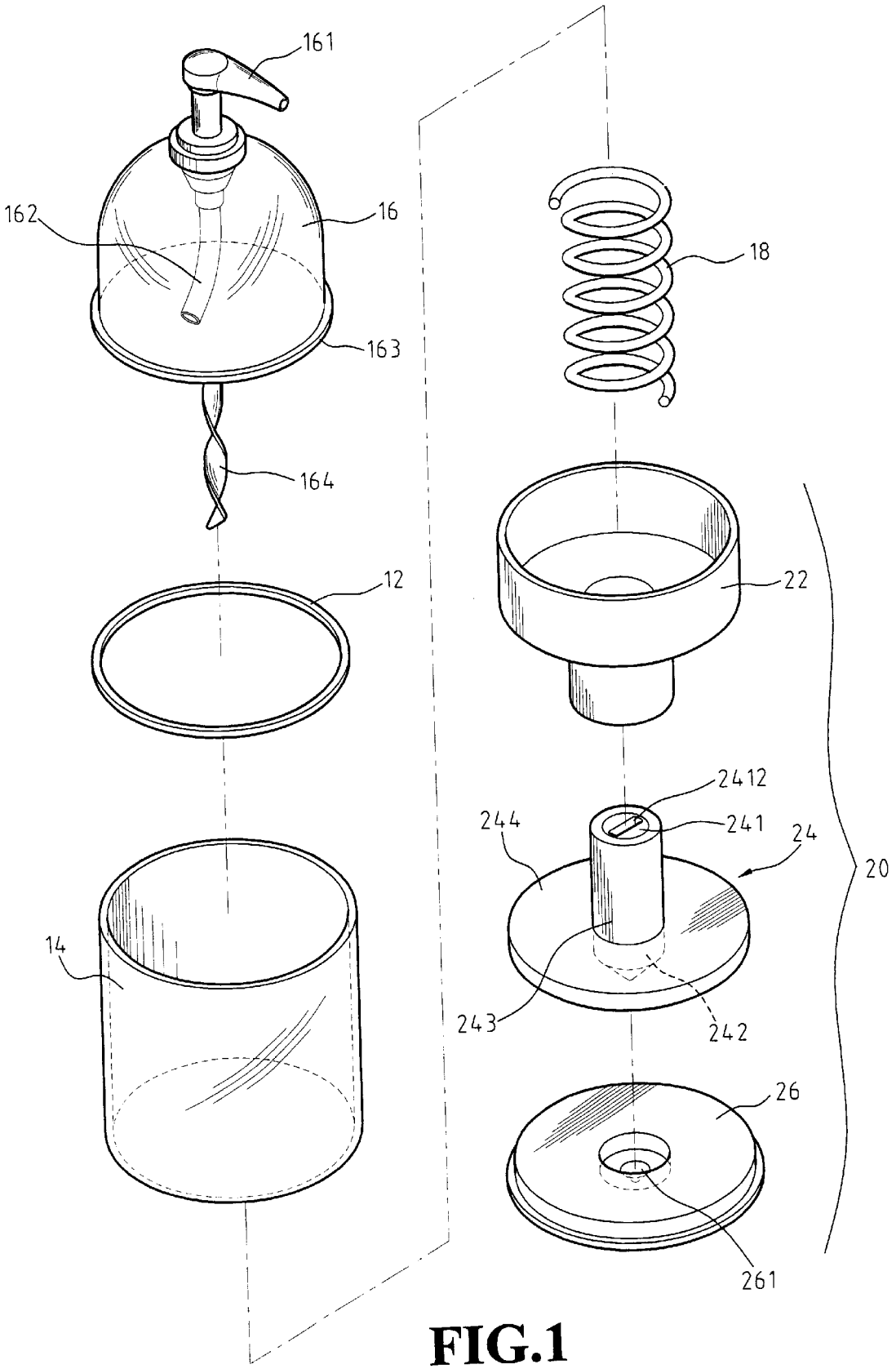
FIG. 1 is an exploded perspective view showing the liquid dispenser with an ornamental device constructed in accordance with the present invention.

With reference to FIGS. 1, a liquid dispenser with an ornamental device constructed in accordance with the present invention is shown. The liquid dispenser has a container 16, a dispensing device 161 mounted to an outlet (not shown) of the container 16, a tube 162 a first end of which is securely connected to the dispensing device 161 and a second end of which extends into the container 16. Because the function and structure of the liquid dispenser are known in the art and are not the focus of the invention, detailed description thereof is thus omitted.

Figure 2:
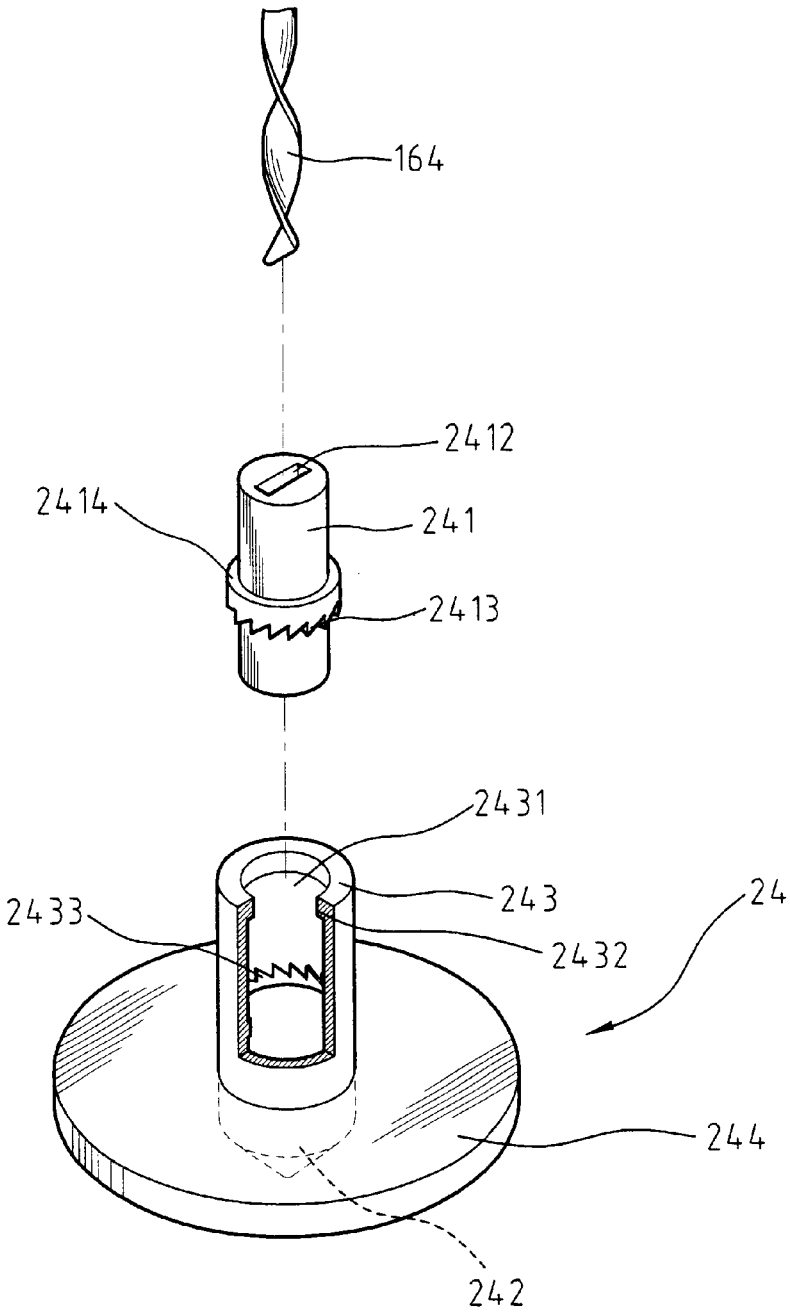
FIG. 2 is an exploded perspective view showing the relationship between the spiral extension and the rotating disk.

The ornamental device, as shown in FIG. 1 and FIG. 2, has a spiral extension 164 securely extending from a bottom 163 of the container 16, a hollow cylinder 14 a clamping ring 12 for securely engaging the hollow cylinder 14 with the bottom 163 of the container 16, a resilient member 18 compressibly mounted around the spiral extension 164 and a free end of which abuts against the bottom 163 of the container 16 and a rotating device 20 received in the hollow cylinder 14. The rotating device 20 has a funneled support 22 provided to position the resilient member 18, a rotating disk 24 with a disk 244, a tube 243 securely extending from the disk 244 and having a stud 241 received therein, a cone-shaped extension 242 and a base 26 provided with a recess 261 defined for receiving the cone-shaped extension 242 therein.

It is noted especially from FIG. 2 that the stud 241 has a slot 2412 defined to receive the free end of the spiral extension 164, a first inclined gear 2413 and a first flange 2414. The tube 243 has a central hole 2431 defined to receive the stud 241 therein, a second flange 2432 formed to engage with the first flange 2414 so as to maintain the stud 241 in the central hole 2431 and a second inclined gear 2433 formed to engage with the first inclined gear 2413.

Figure 3:
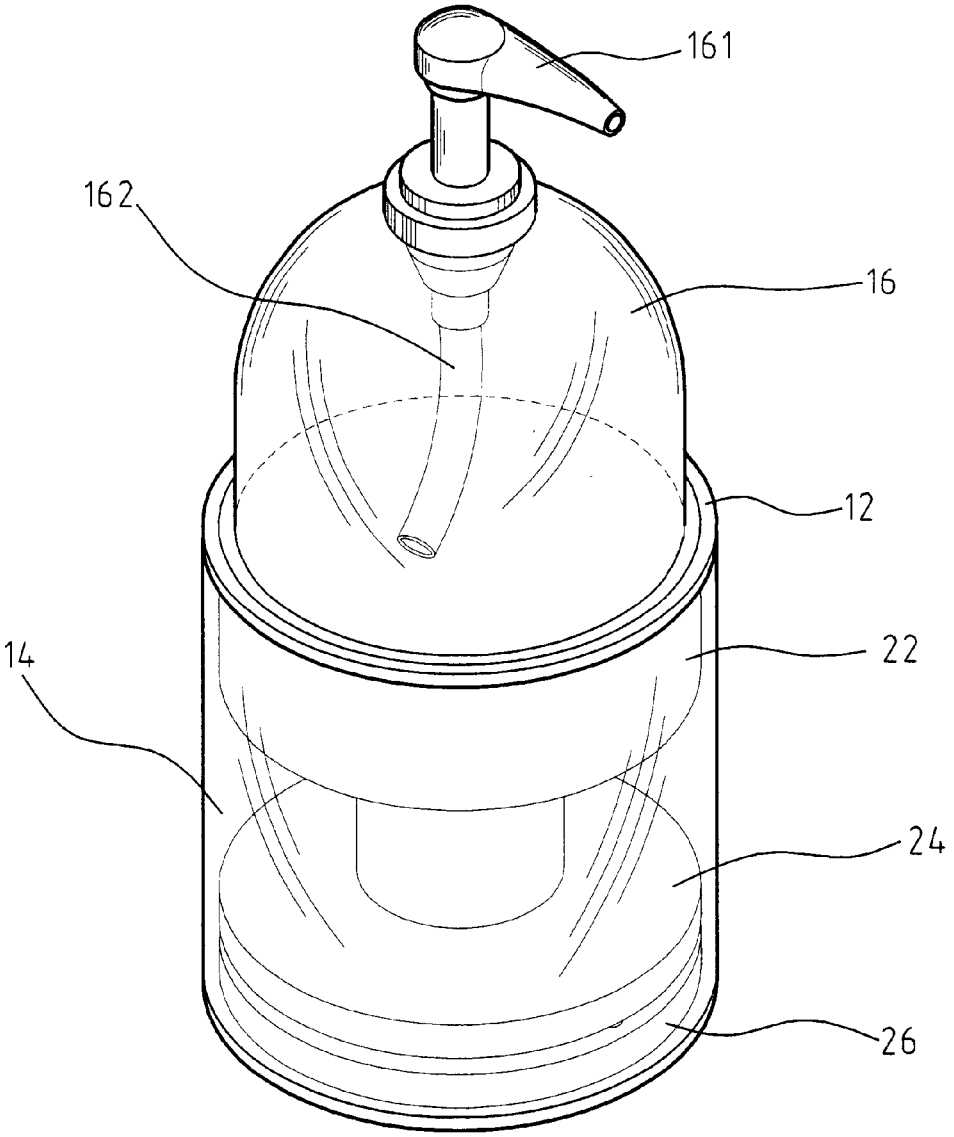
FIG. 3 is a perspective view showing the assembled liquid dispenser with an ornamental device of the invention.

When in assembly, the hollow cylinder 14 is securely engaged with the liquid dispenser 16 by means of the clamping ring 12. The resilient member 18 is mounted around the spiral extension 164 and the free end of the spiral extension 164 extends into the slot 2412 of the stud 241. The stud 241 is received in the tube 243 and having the first inclined gear 2413 mated with the second inclined gear 2433. Then the cone-shaped extension 242 is seated in the recess 261 of the base 26. In the end, the periphery of the base 26 securely engages with the periphery of the hollow cylinder 14, as shown in FIG. 3.

Figure 4:
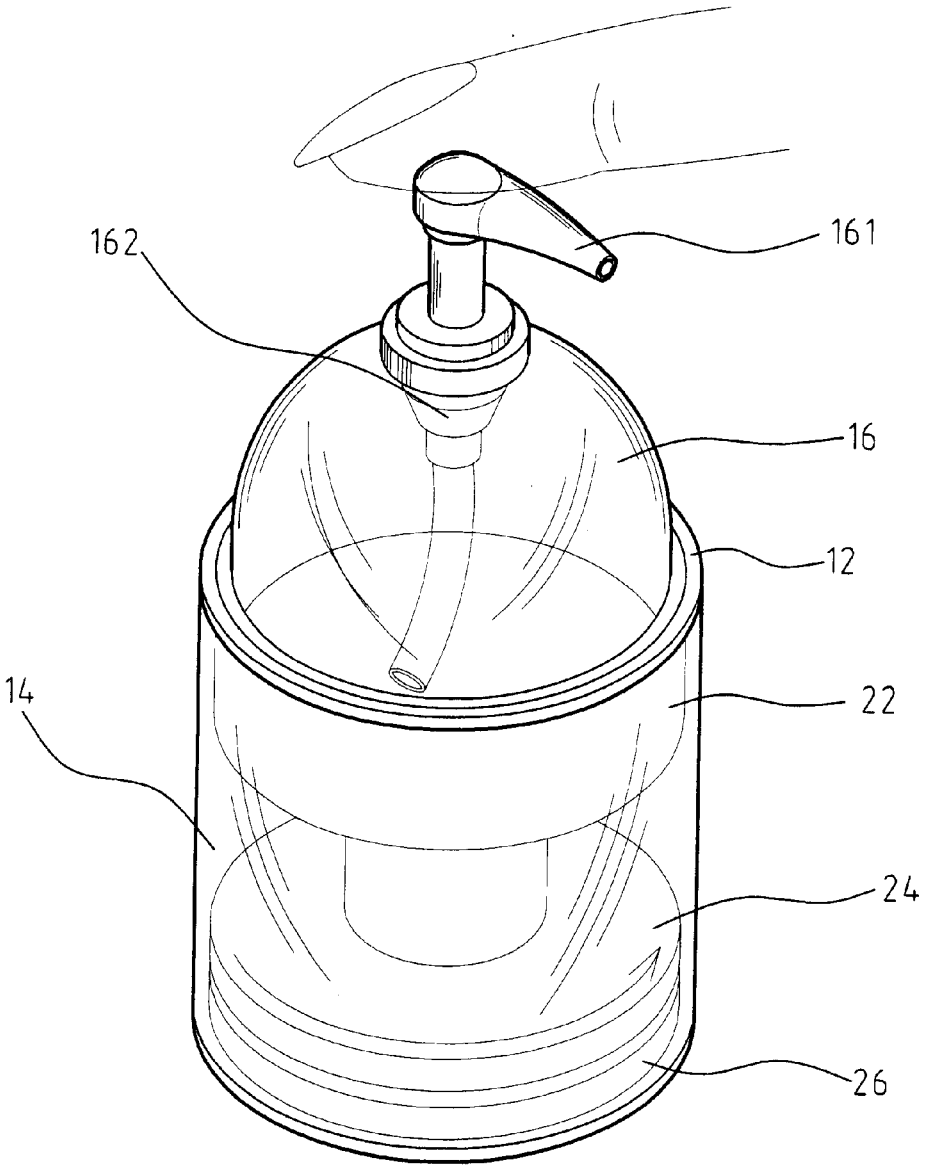
FIG. 4 is a perspective view showing the effect caused by the press of a user.

When the dispensing device 161 is pressed downward by the user, as shown in FIG. 4, the downward force will also cause the spiral extension to extend deeper into the slot 2412 of the stud 241. Due to the design of the spiral shape of the spiral extension 164, the stud 241 will be forced to rotate accordingly. Furthermore, because the engagement between the first and the second inclined gears 2413, 2433, the tube 243 and the disk 244 will rotate together with the stud 241. The recess 261 in the base 26 will help the rotation of the cone-shaped extension 242 smooth and steady.

Figure 5:
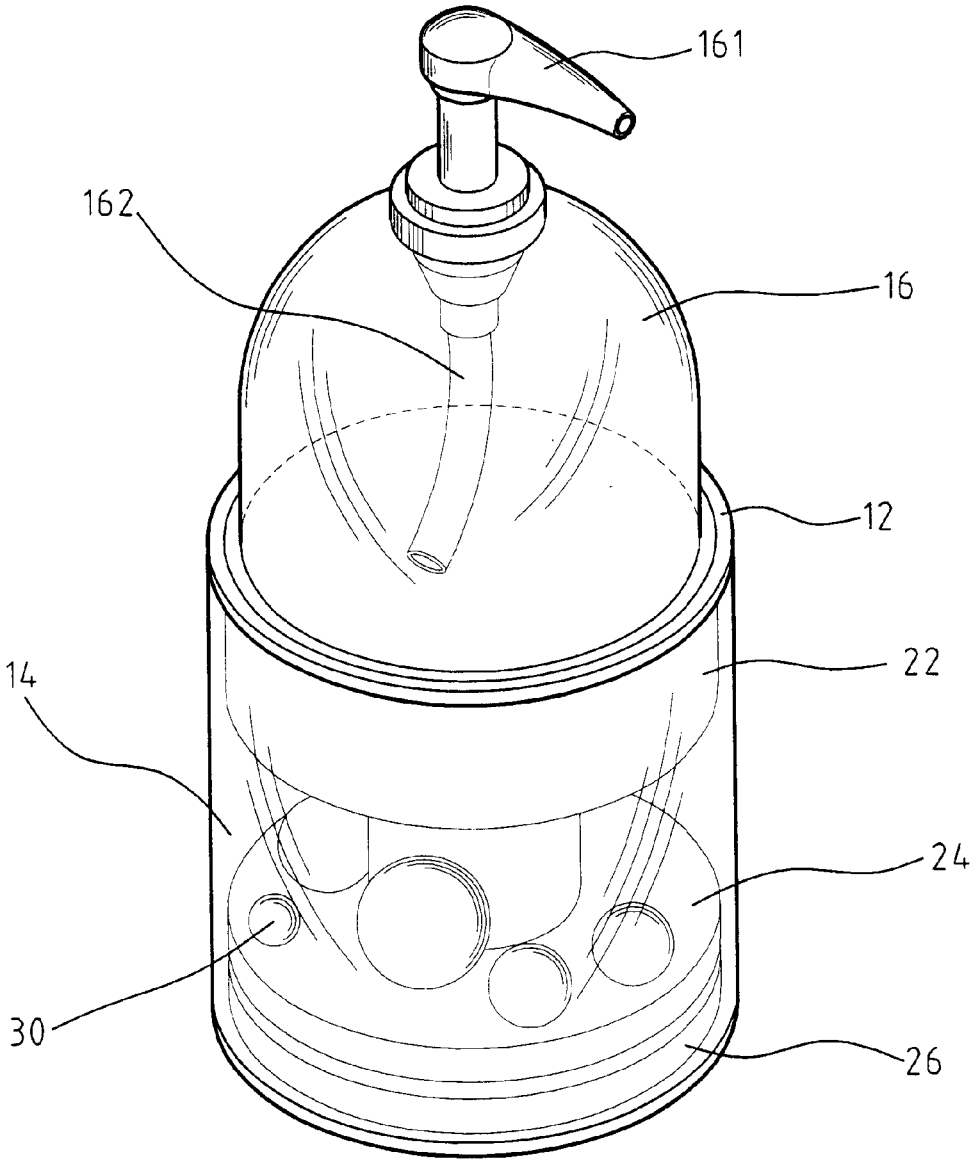
FIGS. 5 and 6 are embodiments showing different objects are mounted onto the rotating disk to create different ornamental effects.
Figure 6:
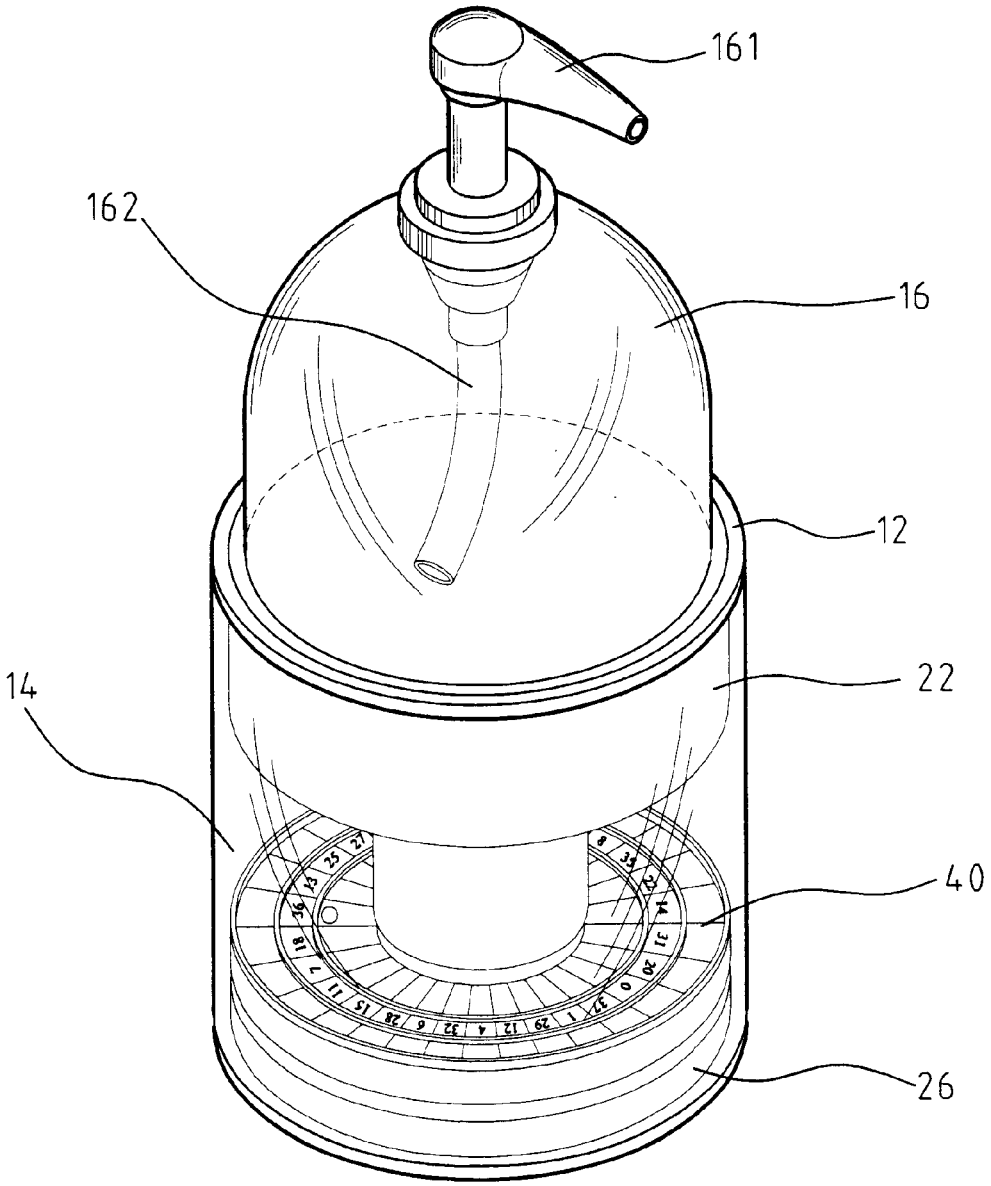

With reference to FIG. 5 and FIG. 6, a plurality of balls 30 are received between the hollow cylinder 14 and the funneled support 22, such that when the rotating disk 24 rotates every time the dispensing device 161 is pressed, the balls 30 will randomly move in the hollow cylinder 14, which increases the attraction to the liquid dispenser. If a roulette 40 is mounted onto the disk 244, the rotation of the disk 244 will also rotate the roulette 40, which increase the entertainment effect to the liquid dispenser.

Therefore, it is concluded that the ornamental device of the invention increases the overall attraction to the liquid dispenser.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An ornamental device attached to a liquid dispenser having a container, a dispensing device mounted to an outlet of the container, a tube a first end of which is securely connected to the dispensing device and a second end of which extends into the container, the ornamental device comprising:

a spiral extension securely extending from a bottom of the container;

a hollow cylinder;

a clamping ring for securely engaging the hollow cylinder with the bottom of the container;

a resilient member compressibly mounted around the spiral extension and a free end of which abuts against the bottom of the container; and a rotating device received in the hollow cylinder.

2. The ornamental device as claimed in claim 1, wherein the rotating device has a funneled support provided to position the resilient member, a rotating disk with a disk, a tube securely extending from the disk and having a stud received therein, a cone-shaped extension extending from the disk and a base provided with a recess defined for rotatably receiving the cone-shaped extension therein.

3. The ornamental device as claimed in claim 1, wherein the resilient member is a spring.

4. The ornamental device as claimed in claim 2, wherein the stud has a first inclined gear and the tube has a second inclined gear corresponding to the first inclined gear.

5. The ornamental device as claimed in claim 2, wherein the stud has a first flange and the tube has a second flange formed to engage the first flange to limit the movement of the stud within the tube.

* * * * *